US007154222B2

(12) United States Patent
Woo et al.

(10) Patent No.: US 7,154,222 B2
(45) Date of Patent: Dec. 26, 2006

(54) PLASMA DISPLAY PANEL HAVING REINFORCING BARRIER RIBS WITH CURVATURE

(75) Inventors: Seok-Gyun Woo, Ahsan-si (KR); Tae-Kyoung Kang, Ahsan-si (KR)

(73) Assignee: Samsung SDI Co., Ltd, Suwon-si (KR)

( * ) Notice: Subject to any disclaimer, the term of this patent is extended or adjusted under 35 U.S.C. 154(b) by 102 days.

(21) Appl. No.: 10/822,134

(22) Filed: Apr. 9, 2004

(65) Prior Publication Data

US 2004/0201351 A1 Oct. 14, 2004

(30) Foreign Application Priority Data

Apr. 11, 2003 (KR) ..... 2003-0023090
Jul. 22, 2003 (KR) ..... 2003-0050276

(51) Int. Cl.
*H01J 17/49* (2006.01)

(52) U.S. Cl. ..... 313/582; 313/584

(58) Field of Classification Search ..... 313/292, 313/581–587; 345/37, 41, 60, 71; 315/169.4
See application file for complete search history.

(56) References Cited

U.S. PATENT DOCUMENTS 6,242,859 B1 * 6/2001 Betsui et al. ..... 313/584
6,867,546 B1 * 3/2005 Zhang et al. ..... 313/584
2004/0046505 A1 * 3/2004 Kawanishi ..... 313/586

* cited by examiner

*Primary Examiner*—Joseph Williams
*Assistant Examiner*—Bumsuk Won
(74) *Attorney, Agent, or Firm*—Christie, Parker & Hale LLP

(57) ABSTRACT

A plasma display panel includes first and second substrates spaced apart from each other at a distance while proceeding substantially parallel to each other. The first and the second substrates have a display area and a non-display area. A plurality of address electrodes are formed on the first substrate, and covered by a dielectric layer. Main barrier ribs are arranged between the substrates to form discharge cells. Phosphor layer is formed with the discharge cells. A plurality of discharge sustain electrodes are formed on the surface of the second substrate facing the first substrate, and covered by a dielectric layer. Reinforcing barrier ribs are arranged at the non-display area while surrounding the display area, and connected to the main barrier ribs with an outer structure curved toward the outside of the substrates.

25 Claims, 14 Drawing Sheets

PLASMA DISPLAY PANEL HAVING REINFORCING BARRIER RIBS WITH CURVATURE

CROSS REFERENCE TO RELATED APPLICATIONS

This application claims priority to and the benefit of Korea Patent Applications No.: 2003-0023090 filed on Apr. 11, 2003 and No. 2003-0050276 filed on Jul. 22, 2003, both filed at the Korean Intellectual Property Office, the entire contents of which are incorporated herein by reference.

BACKGROUND OF THE INVENTION (a) Field of the Invention

The present invention relates to a plasma display panel (PDP), and in particular, to a barrier rib for a plasma display panel.

(b) Description of Related Art

Recently, the PDP has been spotlighted as a candidate for a wide screen display devices, such as a wall-mounted TVs and others. The PDP performs its displaying operation with a discharge mechanism realized at discharge cells. The discharge cells are formed by barrier ribs placed on the substrates in a suitable pattern (stripe or lattice).

As is well known in the art, the PDP is supported by a chassis base mounting a plurality of driving circuit boards at its rear side, and a front cabinet and a back cover are arranged at the front and the back of the PDP and chassis base, respectively. The front cabinet and the back cover are combined with each other in a body while interposing the PDP and the chassis base, thereby forming the outer structure of the display device.

The PDP-oriented display device has the advantages of a thin-thickness, and a light weight. However, when the display device undergoes impact or vibration of external loading, the PDP is liable to be bent or twisted, and this exhibits a structural weakness thereof.

With the PDP display device, the chassis base endures most of the loads and the distortions pursuant thereto, but is limited in its structural intensity. When an excessive external load is applied to the display device, the chassis base does not disperse it in a suitable manner. The excessive external load reaches the PDP, and particularly the barrier ribs mounted within the PDP, so that the substrates or the barrier ribs are broken or ruptured. In this case, the broken fractions of the substrates or the barrier ribs float in the PDP, and are introduced into the discharge cells, thereby interrupting or stopping the discharge operation within the relevant discharge cells. The resulting abnormal discharge can break the dielectric, causing device failure.

The PDP barrier ribs include main barrier ribs placed on the substrates within the display area where the display images are substantially made and dummy barrier ribs placed at the non-display area surrounding the display area. FIG. 16 is a schematic view of main and dummy barrier ribs in a PDP according to the prior art. FIG. 17 is a cross-sectional view of the PDP taken along the A—A line of FIG. 16. As can be seen, the main barrier ribs are formed with a stripe pattern. Dummy barrier ribs 3 contact the end portions 1*a* of main barrier ribs 1, and proceed perpendicular to main barrier ribs 1 (in the X direction of the drawing), thereby interconnecting the end portions 1*a* of main barrier ribs 1.

Barrier ribs 5 having main barrier ribs 1 and dummy barrier ribs 3 are formed using the technique of screen printing, sand blasting, squeezing, or photo processing. With techniques where firing is needed, the barrier rib paste is patterned and fired at 450° C. or more. With the firing process, the impurities and the binder residue in the barrier rib paste are fired, and the barrier rib paste is hardened to form a hard barrier rib.

When the barrier rib paste is fired, the paste-based film is contracted from its initial patterned state. The contraction proceeds along the direction of the length of the barrier rib to be formed later (in the Y direction of FIG. 16).

The paste portion corresponding to the end portion 1*a* of main barrier rib 1 is contracted toward the inside of the display area upon receipt of the contraction force (in the arrow direction of the drawing) directed thereto, and the paste portion corresponding to dummy barrier rib 3 is contracted while resisting the distortion of the paste portion corresponding to main barrier rib 1.

Assume in relation to the drawings that the horizontal portion of the dummy barrier rib 3 is indicated by a, the vertical portion of dummy barrier rib 3 connected to the end portion 1*a* of main barrier rib 1 by b, and end portion 1*a* of main barrier rib 1 placed within display area by c. The paste portion corresponding to vertical portion b of dummy barrier rib 3 is contracted and caved to a predetermined depth, due to the contraction force of the paste portion corresponding to main barrier rib 1 and the resistance force of the paste portion corresponding to dummy barrier rib 3. As shown in FIG. 17, the caved vertical portion of dummy barrier rib 3 is indicated by reference numeral 7. Furthermore, with the firing process, the paste portion corresponding to main barrier rib 1 and dummy barrier rib 3 is contracted, and as shown in FIG. 18, the corner portion of dummy barrier rib 3 is liable to be bent toward main barrier rib 1.

Accordingly, with the PDP having the above-structured barrier ribs 5, the bridge portion between main barrier rib 1 and dummy barrier rib 3 is unstably formed so that as shown in FIG. 19, gap 11 is made between the top surface of barrier rib 5 and front substrate 9. Consequently, a vibration is induced between front substrate 9 and rear substrate 13 while incurring noises, and this impairs the product quality and the structural stability of the PDP.

SUMMARY OF THE INVENTION

In accordance with the present invention, a PDP is provided which enhances structural intensity and minimizes damage due to external loading. A PDP is also provided which prevents a barrier rib from being distorted due to firing and makes the shape thereof uniform. A PDP is further provided which removes a possible gap between the barrier rib and a substrate and prevents noise occurrence due thereto.

According to one aspect of the present invention, the PDP includes first and second substrates spaced apart from each other at a distance and proceeding substantially parallel to each other. The first and the second substrates have a display area and a non-display area. A plurality of address electrodes are formed on the first substrate and are covered by a dielectric layer. Main barrier ribs are arranged between the substrates to form discharge cells and a phosphor layer is formed within the discharge cells. A plurality of discharge sustain electrodes are formed on the surface of the second substrate facing the first substrate and are covered by a dielectric layer. Reinforcing barrier ribs are arranged at the non-display area while surrounding the display area and are connected to the main barrier ribs with an outer structure curved toward the outside of the substrates.

The reinforcing barrier ribs surround at least one edge of the display area.

The reinforcing barrier ribs may surround all four edges of the display area.

The thickness of the reinforcing barrier ribs is substantially the same as the thickness of the main barrier ribs.

The reinforcing barrier ribs have a width gradually reduced from the center thereof to both end portions thereof.

The reinforcing barrier ribs are outlined with an arc, or a plurality of arcs.

The arc portions of the reinforcing barrier ribs are differentiated in the thickness thereof.

The arc portion of the reinforcing barrier rib with the small thickness is thinner than the thickness of the main barrier rib.

The respective arc portions of the reinforcing barrier ribs correspond to a discharge cell formed by the main barrier ribs, or two or more discharge cells formed thereby.

According to another aspect of the present invention, the PDP includes: first and second substrates facing each other, address electrodes formed on the first substrate, and main barrier ribs arranged between the first and the second substrates within a display area to form discharge cells. A phosphor layer is formed at the respective discharge cells. A plurality of discharge sustain electrodes are formed on the second substrate. Dummy barrier ribs are arranged at a non-display region sided with at least one end portion of the display area. The dummy barrier ribs include main dummy barrier ribs spaced apart from the end portions of the main barrier ribs at a distance while proceeding in a direction of the display area. Interconnection dummy barrier ribs extend from the main dummy barrier ribs toward the main barrier ribs with a curvature and are connected to the main barrier ribs.

The dummy barrier ribs are arranged at non-display regions sided with two opposite-end portions of the display area facing each other. The main dummy barrier ribs proceed perpendicular to the address electrodes.

The dummy barrier ribs are arranged at non-display regions sided with the other two opposite-end portions of the display area facing each other. The main dummy barrier ribs proceed parallel to the address electrodes.

The main dummy barrier ribs have a plurality of arc portions serially connected to each other, and the arc portions are convex toward the outside of the substrates.

The arc portions have substantially the same curvature as the interconnection dummy barrier ribs.

The main dummy barrier rib and the interconnection dummy barrier ribs are connected to each other to form an arc portion.

The dummy barrier ribs further have subsidiary dummy barrier ribs placed at the one-sided region of the main dummy barrier ribs facing the main barrier ribs. The subsidiary dummy barrier ribs are extended toward the main barrier ribs substantially with the same curvature as the arc portions.

The subsidiary dummy barrier ribs are arranged between the two interconnection dummy barrier rib neighbors pair by pair.

Separation barrier ribs are provided between the main barrier ribs and the dummy barrier ribs and proceed substantially parallel to the main dummy barrier ribs.

DETAILED DESCRIPTION

Figure 1:
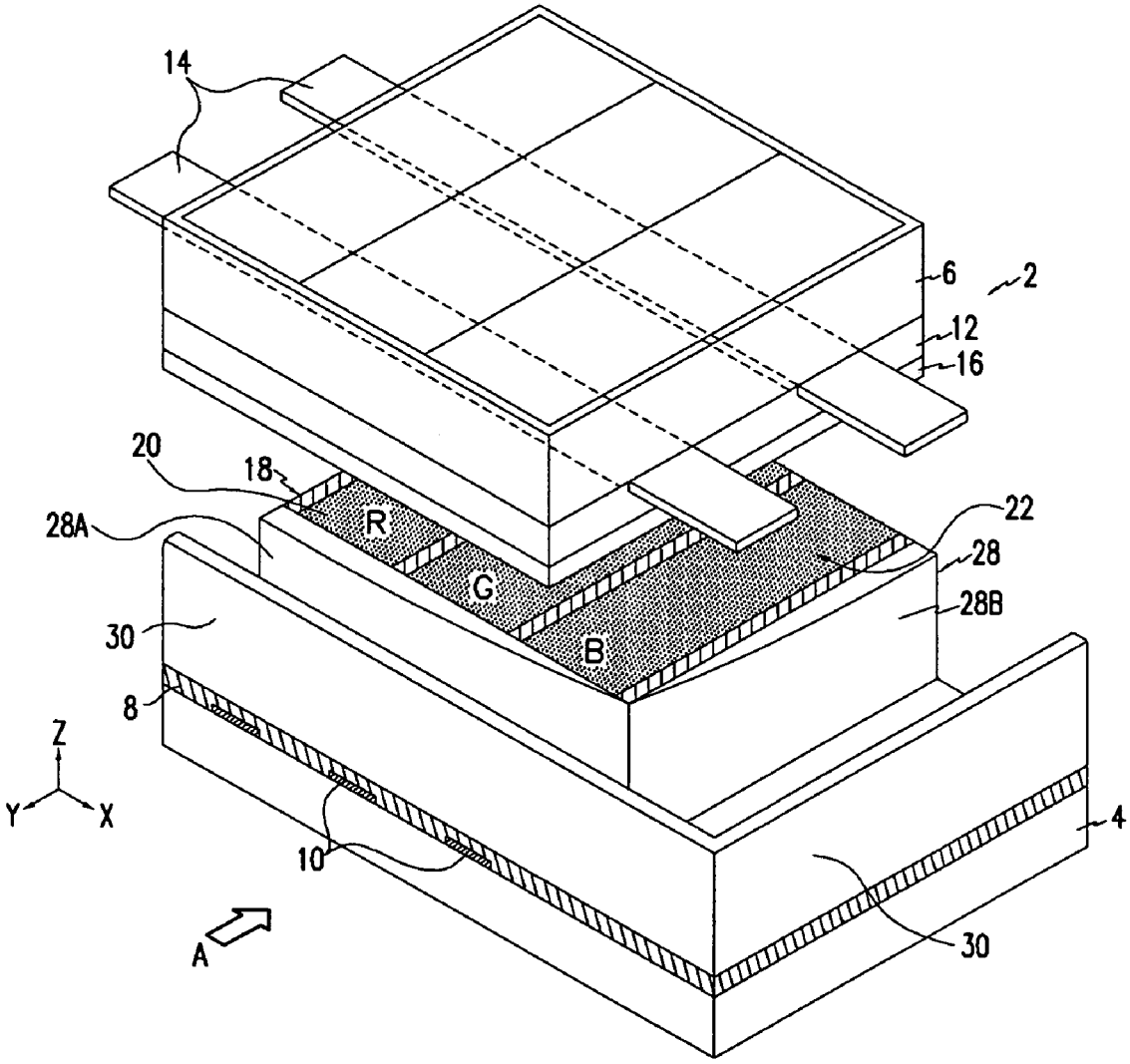
FIG. 1 is a partial exploded perspective view of a PDP according to a first embodiment of the present invention.
Figure 2:
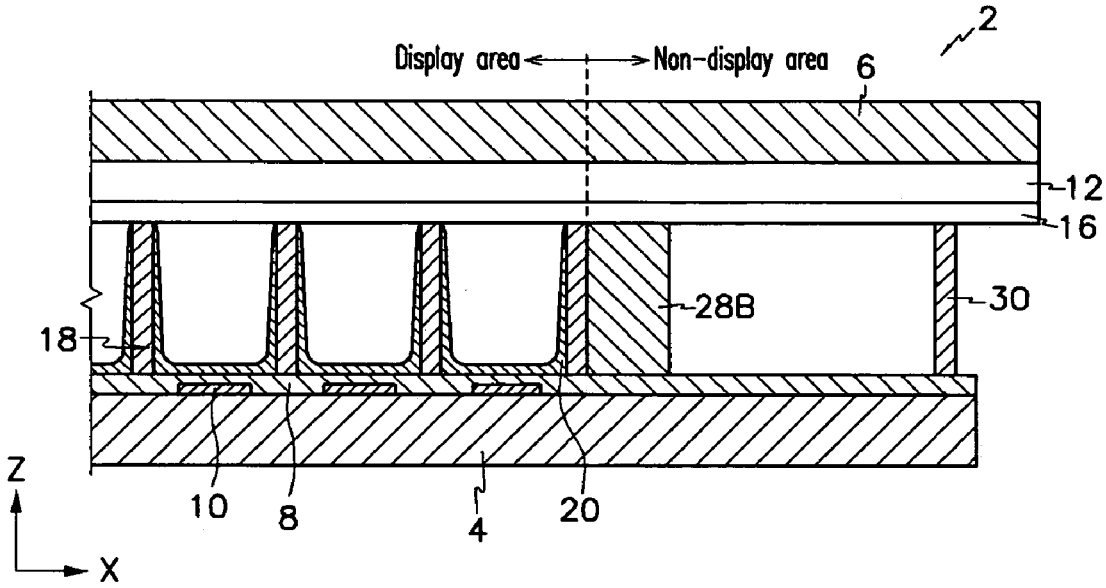
FIG. 2 is a partial combined sectional view of the PDP taken in the direction of the arrow A of FIG. 1.

Referring to FIGS. 1 and 2, PDP 2 has first transparent substrate 4 and second transparent substrate 6 spaced apart from each other with some distance while proceeding substantially parallel to each other, and has a discharge mechanism disposed between the two substrates to make the displaying operation.

Specifically, a plurality of address electrodes 10 are formed on first substrate 4 with a stripe pattern and are covered by dielectric layer 8.

Discharge sustain electrodes 14 are formed on the surface of second substrate 6 facing first substrate 4 with a stripe pattern while proceeding parallel to each other. Discharge sustain electrodes 14 cross over address electrodes 10, and are covered by transparent dielectric layer 12. Discharge sustain electrodes 14 are formed with a transparent material, such as indium tin oxide (ITO).

Transparent protective layer 16 is formed on transparent dielectric layer 12 with MgO. A plurality of main barrier ribs 18 are disposed between first substrate 4 and second substrate 6. Main barrier ribs 18 are arranged between address electrodes 10 while proceeding parallel thereto. Red (R), green (G), and blue (B) phosphor layers 20 are formed on the lateral sides of main barrier ribs 18 and the top surface of dielectric layer 8.

Main barrier ribs 18 are formed with a stripe pattern, but the pattern of main barrier ribs 18 is not limited thereto. For instance, main barrier ribs 18 may be formed with a lattice pattern.

Figure 3:
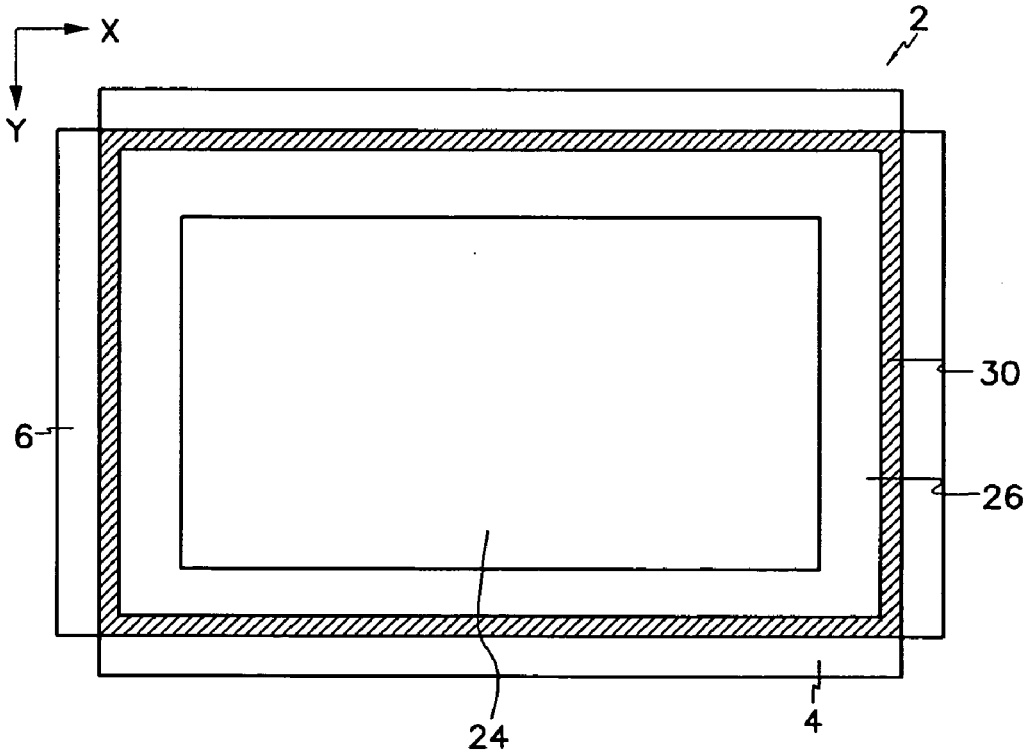
FIG. 3 is a plan view of the PDP according to the first embodiment of the present invention.

The space between main barrier rib neighbors 18 is operated as a discharge space, and a discharge gas (not shown) is injected into the discharge space to form discharge cell 22. Referring to FIGS. 2 and 3, main barrier ribs 18 are placed within display area 24 defined on first substrate 4 and second substrate 6.

In addition to main barrier ribs 18, PDP 2 further has reinforcing barrier ribs 28 formed at non-display area 26 with no discharge cell, while surrounding display area 24. Reinforcing barrier ribs 28 are connected to main barrier ribs 18 with an outer structure curved toward the outside of substrates 4, 6.

Reinforcing barrier ribs 28 may surround any one edge or two opposite edges of display area 24, or all the four edges thereof. The structure where reinforcing barrier ribs 28 surround all the four edges of display area 24 will be now explained in detail.

Figure 4:
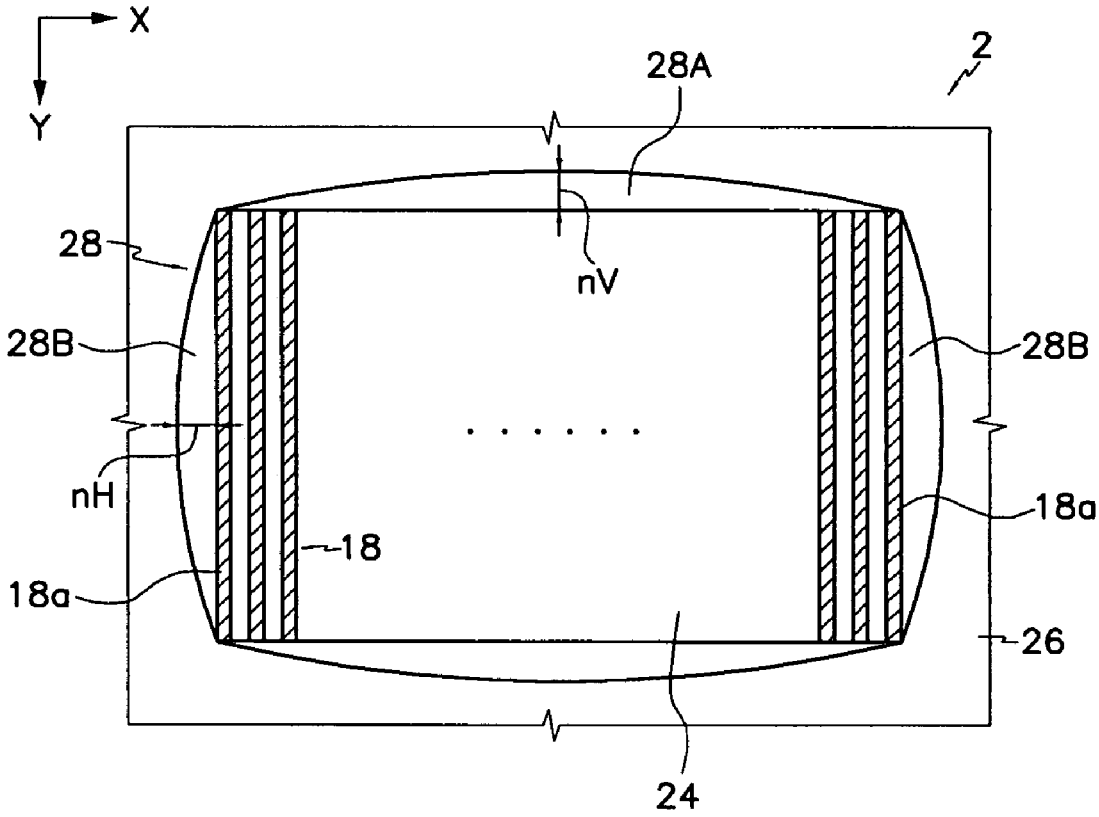
FIG. 4 schematically illustrates main barrier ribs and reinforcing barrier ribs for the PDP shown in FIG. 1.

FIG. 4 schematically illustrates the main barrier ribs and the reinforcing barrier ribs. In this embodiment, reinforcing barrier ribs 28 surround the four edges of display area 24 where main barrier ribs 18 are arranged, and are closely adhered to main barrier ribs 18 at non-display area 26.

Reinforcing barrier ribs 28 may include horizontal reinforcing barrier ribs 28A proceeding in the direction of the long axis of the first and the second substrates (in the X direction of the drawing), and vertical reinforcing barrier ribs 28B proceeding in the direction of the short axis of the first and the second substrates (in the Y direction of the drawing). Horizontal reinforcing barrier ribs 28A are closely adhered to both end portions of main barrier ribs 18 while proceeding perpendicular to main barrier ribs 18. Vertical reinforcing barrier ribs 28B are closely adhered to outermost barrier ribs 18a while proceeding parallel thereto.

Horizontal and vertical reinforcing barrier ribs 28A, 28B are formed with the same thickness, which is identical with that of main barrier rib 18. On the other hand, the width of horizontal reinforcing barrier ribs 28A and vertical reinforcing barrier ribs 28B is largest at the center thereof, and is gradually reduced as they proceed toward the peripheries thereof. This is because when the width of the horizontal and vertical reinforcing barrier ribs 28A, 28B is differentiated in the longitudinal direction thereof, with the application of the external loading to the periphery of display area 24, reinforcing barrier ribs 28 can disperse the external loading more effectively. Accordingly, the respective horizontal and vertical reinforcing barrier ribs 28A, 28B substantially forming reinforcing barrier ribs 28 have an outer structure directed toward the outside of substrates 4, 6 and formed in shape of an arc with a curvature.

When main barrier ribs 18 are formed on first substrate 4 using a screen printing technique, reinforcing barrier ribs 28 may be formed together with the same material.

Figure 5:
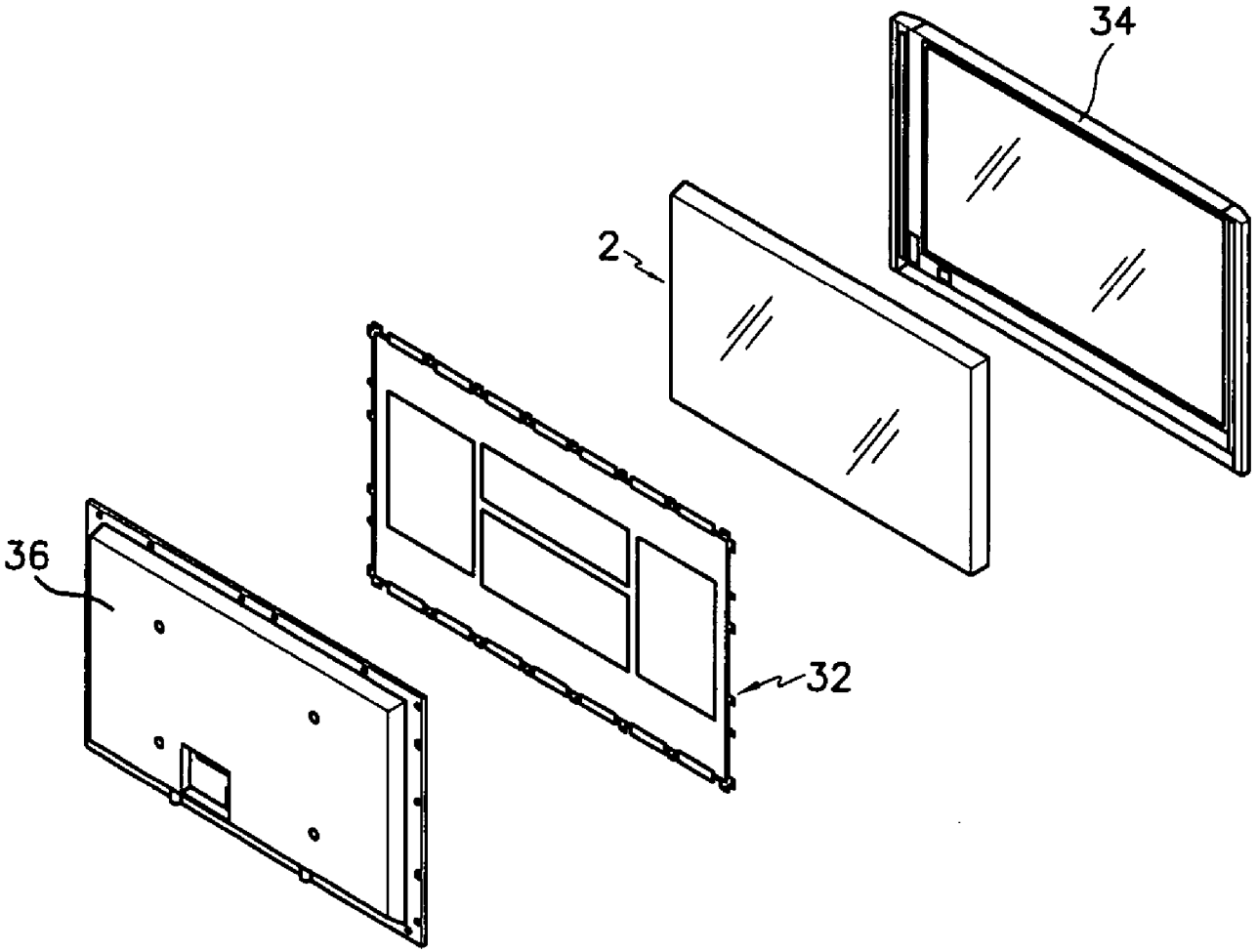
FIG. 5 is an exploded perspective view of a display device using the PDP according to the first embodiment of the present invention.

As seen in FIG. 1, PDP 2 with reinforcing barrier ribs 28 is formed as a display panel where first substrate 4 and second substrate 6 are aligned and sealed to each other by frit 30 at their peripheries. As shown in FIG. 5, PDP 2 is fitted to chassis base 32 mounting a plurality of driving circuit boards thereon. Front cabinet 34 and back cover 36 are arranged at the front and the back of PDP 2 and chassis base 32 and combined with each other in a body.

With the above-structured PDP 2, an address voltage Va is applied between address electrode 10 and any one of the discharge sustain electrodes (Y electrode) to select discharge cell 22, and a sustain voltage Vs is applied to a pair of the discharge sustain electrodes (X and Y electrodes) to induce plasma discharge within discharge cell 22 and excite phosphor film 20 at the relevant discharge cell, thereby displaying the desired images.

In case the display device is under external loading from the outside, such as bending, twisting, impact, and vibration, the load is primarily absorbed by chassis base 32, and the residue thereof not absorbed by chassis base 32 is absorbed by reinforcing barrier ribs 28.

That is, the periphery of PDP 2 where the external load is concentrated is reinforced by reinforcing barrier ribs 28 so that it can completely absorb the external load, thereby preventing main barrier ribs 18 from being broken. The specific experimental results related thereto will be later explained with reference to Tables 1 and 2.

Variations of the PDP according to the first embodiment of the present invention will be now explained with reference to FIGS. 6 to 9.

Figure 6:
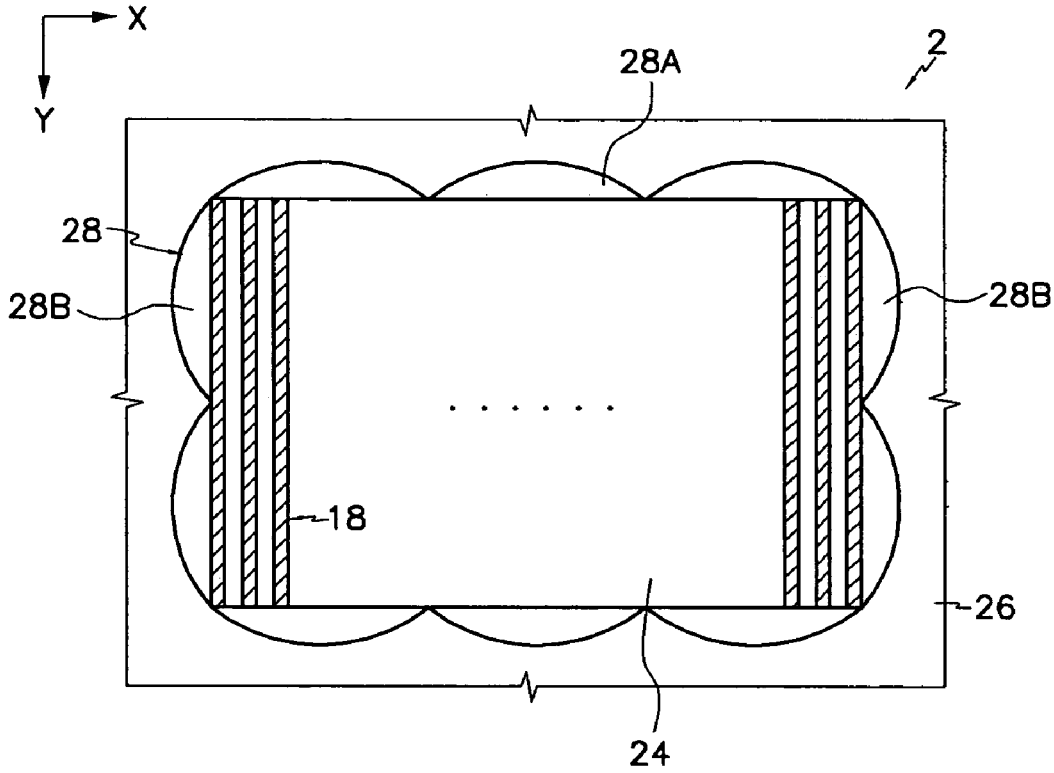
FIG. 6 schematically illustrates a first variation of the PDP according to the first embodiment of the present invention.

FIG. 6 illustrates a first variation of the PDP, which basically has the previously-described structure. With this variation, the horizontal and the vertical reinforcing barrier ribs 28A, 28B involve an outer structure having two or more arcs with different curvature centers, not a single arc with a curvature center.

When the horizontal and vertical reinforcing barrier ribs 28A, 28B are outlined with two or more arcs, they effectively disperse the external load applied to PDP 2, thereby serving to heighten the structural intensity of PDP 2.

Figure 7:
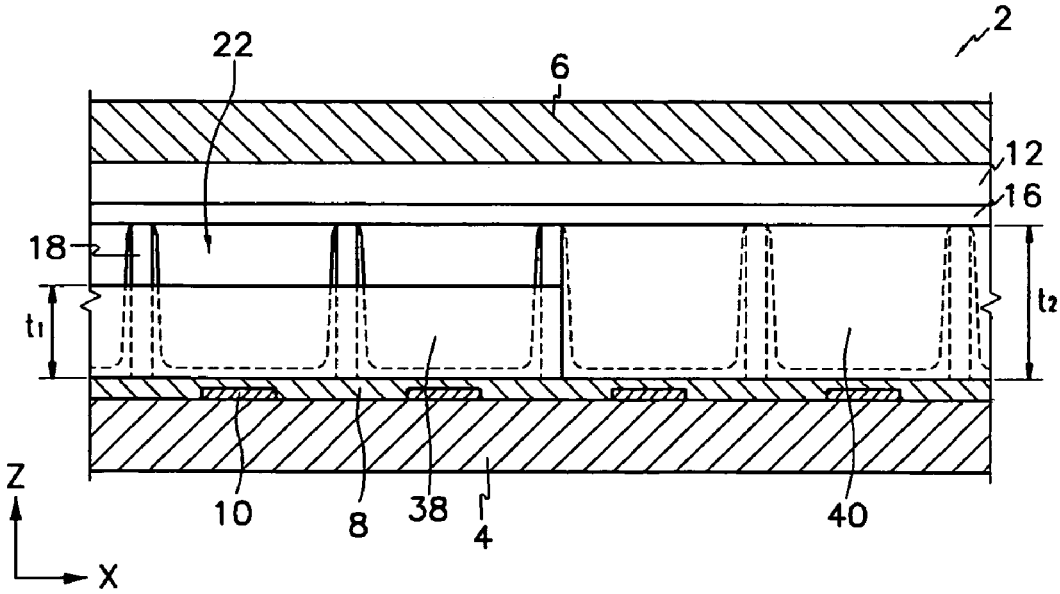
FIG. 7 is a partial sectional view of the PDP according to the first embodiment of the present invention, schematically illustrating a second variation thereof.

FIG. 7 illustrates a second variation of the PDP, which basically has the structure related to the first variation. With the horizontal or vertical reinforcing barrier ribs 28A, 28B, for the convenience in explanation, the arc portions differentiated in the curvature center are classified into first and second sub-reinforcing barrier ribs 38, 40 with different thickness t1, t2.

Preferably, the thickness of the sub-reinforcing barrier rib (for instance, second sub-reinforcing barrier rib 40) with a relatively large dimension is substantially the same as that of main barrier rib 18, and the thickness of the sub-reinforcing barrier rib (for instance, first sub-reinforcing barrier rib 38) with a relatively small dimension is smaller than that of main barrier rib 18.

The sub-reinforcing barrier rib (for instance, first sub-reinforcing barrier rib 38) partially opens discharge cell 22 formed by main barrier ribs 18. With this structure, when PDP 2 is internally exhausted, the exhaustion efficiency can be enhanced with the opening.

Figure 8:
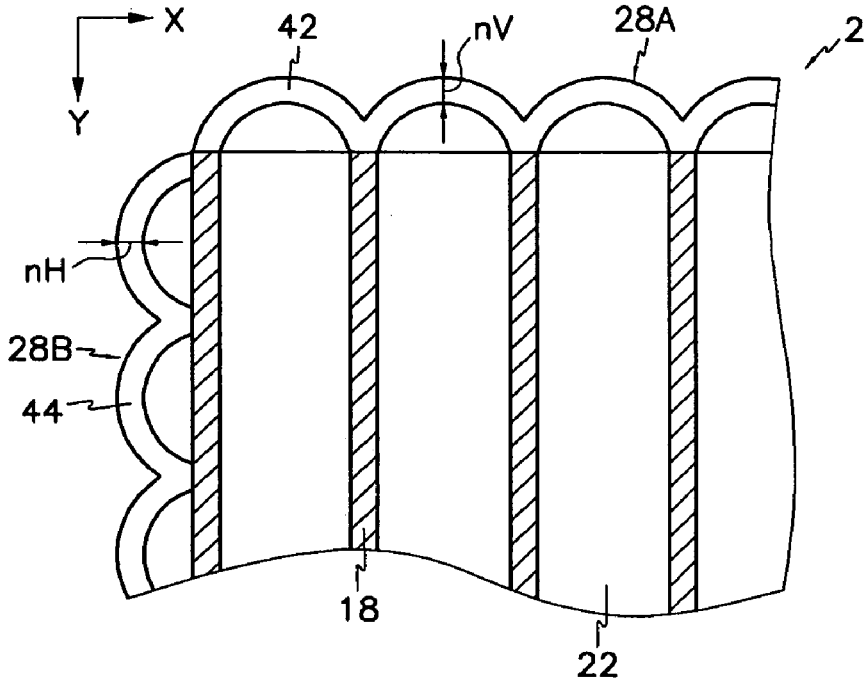
FIG. 8 schematically illustrates a third variation of the PDP according to the first embodiment of the present invention.

FIG. 8 illustrates a third variation of the PDP, which basically has the previously-described structure. With this variation, horizontal and vertical reinforcing barrier ribs 28A, 28B have a plurality of arc portions 42, 44 with different curvature centers, and arc portions 42, 44 have widths nV and widths nH, respectively.

Figure 9:
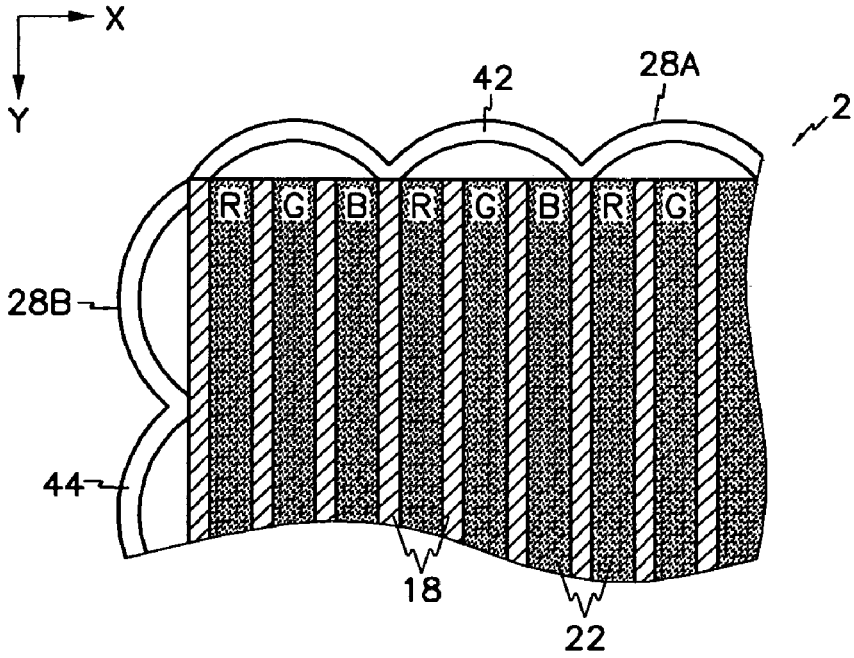
FIG. 9 schematically illustrates a fourth variation of the PDP according to the first embodiment of the present invention.

Particularly, respective arc portions 42 forming horizontal reinforcing barrier rib 28A correspond to discharge cells 22 formed by main barrier ribs 18 one to one, or as shown in FIG. 9, corresponds to one or more discharge cells 22, for instance, three R, G, and B discharge cells 22.

When the external loading is applied to PDP 2, respective arc portions 42, 44 forming horizontal and vertical reinforcing barrier ribs 28A, 28B disperse the external load more effectively to thereby enhance the structural intensity of PDP 2.

Table 1 lists the bending experiment results with respect to the PDP and the chassis base combined with each other. In Table 1, the Comparative Example concerns the PDP with no reinforcing barrier rib, Examples 1 to 5 the PDPs with the reinforcing barrier ribs related to the first embodiment of the present invention, and Examples 6 to 10 the PDPs with the reinforcing barrier ribs related to the third variation of the first embodiment of the present invention. The Comparative Example and the Examples all utilize the same chassis base.

In Table 1, the values nV, nH of the Examples 1 to 5 indicate the central widths of horizontal and vertical reinforcing barrier ribs 28A, 28B, as shown in FIG. 4. The values nV, nH of the Examples 6 to 10 indicate the widths of arc portions 42, 44 forming horizontal and vertical reinforcing barrier ribs 28A, 28B, as shown in FIG. 8.

Furthermore, in Table 1, the breakage load indicates the force applied to the center of the chassis base up to the breakage of the PDP and the chassis base, and the deflection indicates the maximum deflection degree when the PDP and the chassis base are broken due to the breakage load.

TABLE 1

| | nV (mm) | nH (mm) | Breakage load (kg) | Deflection (mm) |
|---|---|---|---|---|
| Comparative Example | 0 | 0 | 35.55 | 0.807 |
| Example 1 | 5 | 5 | 38.77 | 1.106 |
| Example 2 | 10 | 10 | 42.10 | 1.609 |
| Example 3 | 30 | 30 | 56.55 | 2.222 |
| Example 4 | 50 | 50 | 65.12 | 3.530 |
| Example 5 | 70 | 70 | 70.55 | 4.200 |
| Example 6 | 5 | 5 | 45.66 | 1.702 |
| Example 7 | 10 | 10 | 50.01 | 2.201 |
| Example 8 | 30 | 30 | 62.25 | 2.658 |
| Example 9 | 50 | 50 | 70.05 | 4.230 |
| Example 10 | 70 | 70 | 77.00 | 5.020 |

As listed in Table 1, compared to the PDP with no reinforcing barrier rib according to the Comparative Example, the PDPs with reinforcing barrier ribs according to the Examples 1 to 5 involved the breakage load increased maximally by 1.98 times and the deflection increased maximally by 5.2 times, and the PDPs with reinforcing barrier ribs according to the Examples 6 to 10 involved the breakage load increased maximally by 2.17 times, and the deflection increased maximally by 6.22 times.

In view of the experimental results, it is confirmed that the structural intensity of the PDP according to the embodiment of the present invention is reinforced by the reinforcing barrier ribs, and the endurance thereof against the bending load is strengthened. Particularly, it can be seen that the reinforcing barrier ribs related to the third variation are very advantageous in reinforcing the intensity of the PDP against the bending load.

Table 2 lists the twisting experiment results with respect to the PDP and the chassis base. The conditions for the Comparative Example, the Examples 1 to 5 and the Examples 6 to 10 were the same as those related to the previously-described bending experiment. The twisting experiment was conducted through completely fixing the one-sided end portion of the assembly of the PDP and the chassis base, installing a ball bearing jig at the left edge of the opposite-sided end portion thereof, and applying a vertical twisting load to the right edge thereof.

In Table 2, the breakage load indicates the vertical load applied to the PDP and the chassis base up to the breakage thereof, and the deflection indicates the maximum deflection degree when the PDP and the chassis base are broken.

TABLE 2

| | nV (mm) | nH (mm) | Breakage load (kg) | Deflection (mm) |
|---|---|---|---|---|
| Comparative Example | 0 | 0 | 57.67 | 3.940 |
| Example 1 | 5 | 5 | 61.72 | 4.577 |
| Example 2 | 10 | 10 | 69.91 | 5.088 |
| Example 3 | 30 | 30 | 75.55 | 5.618 |
| Example 4 | 50 | 50 | 81.12 | 6.401 |
| Example 5 | 70 | 70 | 89.32 | 7.011 |
| Example 6 | 5 | 5 | 45.66 | 5.052 |
| Example 7 | 10 | 10 | 74.66 | 5.516 |
| Example 8 | 30 | 30 | 79.31 | 6.129 |
| Example 9 | 50 | 50 | 90.55 | 7.068 |
| Example 10 | 70 | 70 | 98.00 | 7.654 |

As listed in Table 2, compared to the PDP with no reinforcing barrier rib according to the Comparative Example, the PDPs with reinforcing barrier ribs according to the Examples 1 to 5 involved the breakage load increased maximally by 1.55 times and the deflection increased maximally by 1.78 times, and the PDPs with reinforcing barrier ribs according to the Examples 6 to 10 involved the breakage load increased maximally by 1.7 times, and the deflection increased maximally by 1.94 times.

In view of the experimental results, it is confirmed that the structural intensity of the PDP according to the embodiment of the present invention is reinforced by the reinforcing barrier ribs, and the endurance thereof against the twisting load is strengthened. Particularly, it can be seen that the reinforcing barrier ribs related to the third variation are very advantageous in reinforcing the intensity of the PDP against the twisting load.

As described above, the structural intensity of the PDP according to the first embodiment of the present invention is reinforced by the reinforcing barrier ribs so that when an external loading, such as bending, twisting, impact, and vibration, is applied to the PDP, the breakage of the PDP like the collapsing of the barrier ribs can be minimized. Accordingly, even though the external load not absorbed by the chassis base is applied to the PDP, the breakage thereof can be prevented, and the discharge cells can be operated in a stable manner.

A PDP according to a second embodiment of the present invention will be now explained in detail.

Figure 10:
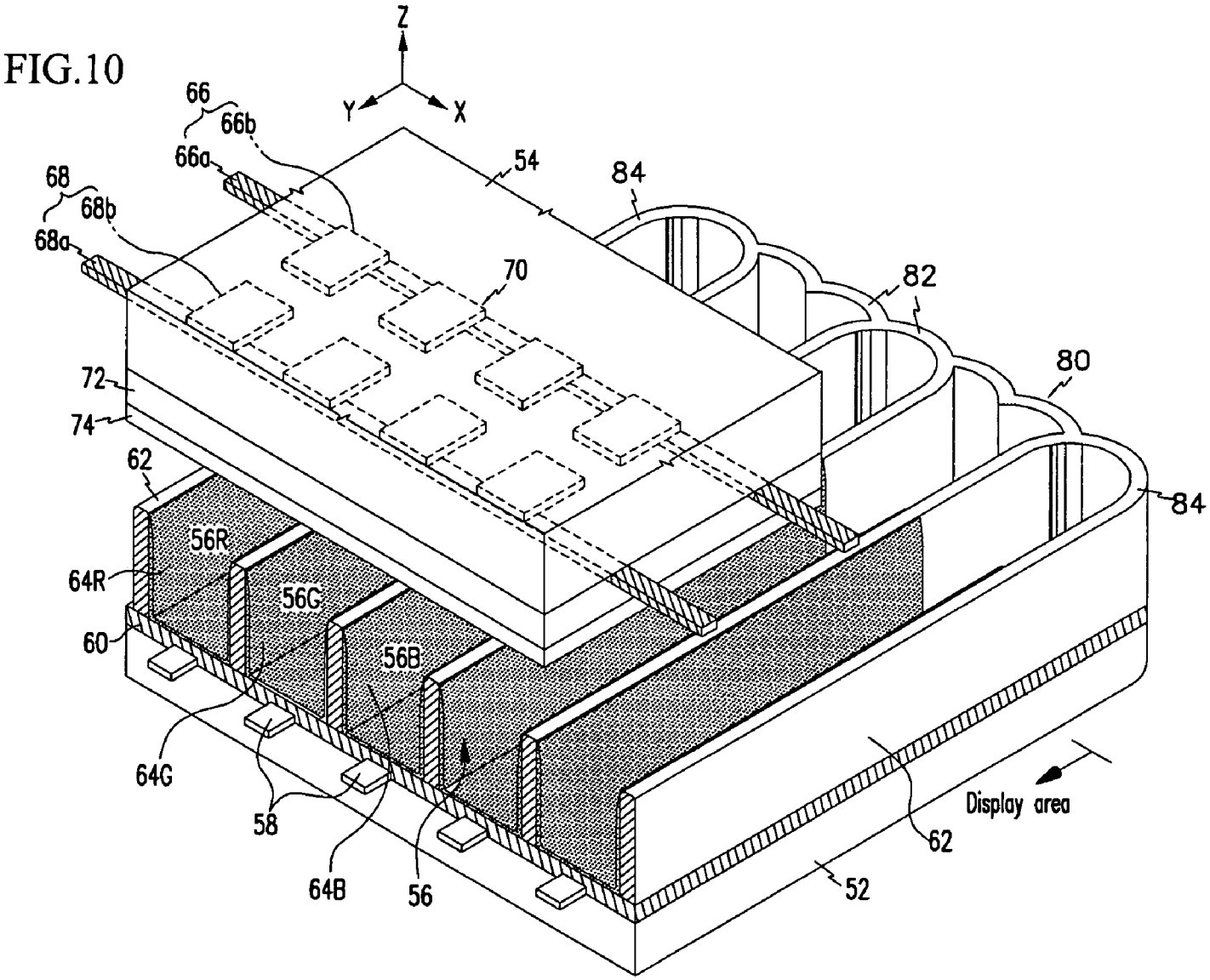
FIGS. 10 and 11 are a partial exploded perspective view of a PDP according to a second embodiment of the present invention, and a plan view thereof.
Figure 11:
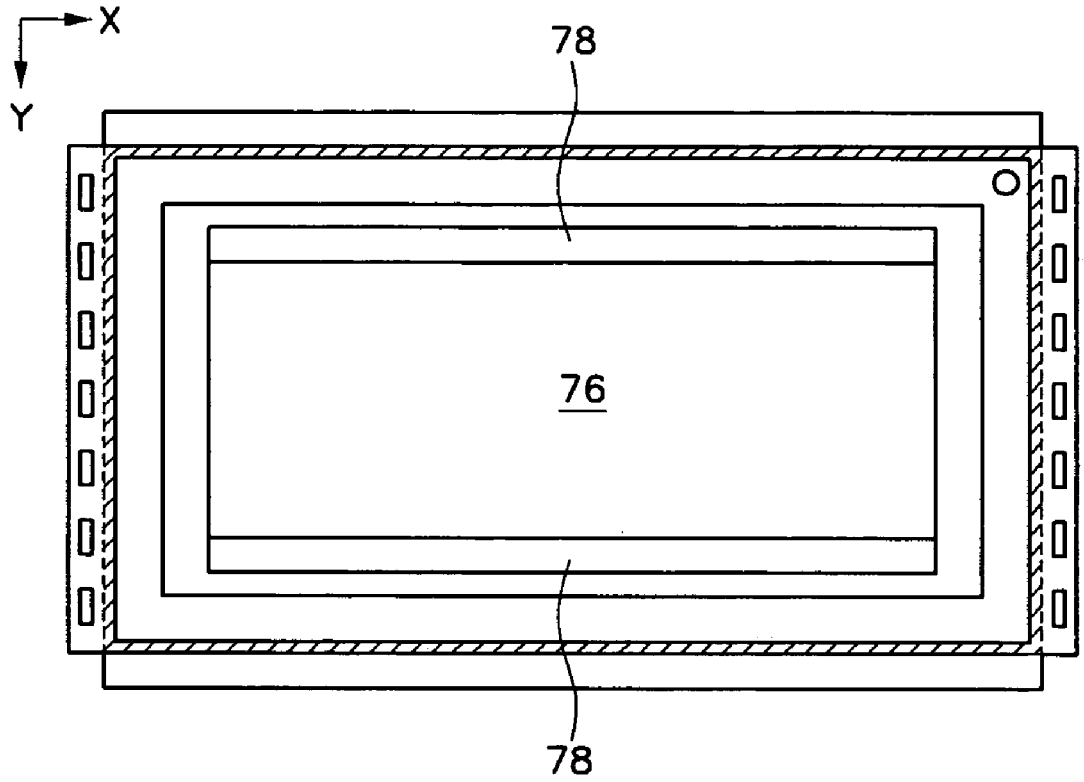

FIGS. 10 and 11 are a partial exploded perspective view of a PDP according to a second embodiment of the present invention and a schematic plan view thereof, respectively.

As shown in the drawings, the PDP includes first and second substrates 52, 54 facing each other with some distance, and discharge cells 56R, 56G, 56B disposed between the substrates 52, 54. Each cell 56 has an independent discharge mechanism to emit visible rays, and display the desired color image.

Specifically, address electrodes 58 are formed on the inner surface of first substrate 52 while proceeding in a direction (in the Y direction of the drawing). Bottom dielectric layer 60 is formed on the entire inner surface of first substrate 52 while covering address electrodes 58. Address electrodes 58 are stripe-patterned, and spaced apart from each other at a predetermined distance while proceeding parallel to each other.

Main barrier ribs 62 are formed on bottom dielectric layer 60 while being stripe-patterned and proceeding parallel to address electrodes 58. R, G, and B phosphor layers 64R, 64G, 64B are formed on the lateral sides of barrier ribs 62 and on the top surface of dielectric layer 60. Main barrier ribs 62 are disposed between address electrode neighbors 58 while proceeding parallel thereto. Main barrier ribs 62 are standing between first and second substrates 52, 54 with a height to form a discharge space. The pattern of main barrier ribs 62 is not limited to the stripe pattern, but may be formed with a lattice or other shapes.

Discharge sustain electrodes 70 are formed on the inner surface of second substrate 44 facing first substrate 52 in a direction perpendicular to address electrodes 58 (in the X direction of the drawing). Discharge sustain electrodes 70 are formed with scan electrodes 66 and display electrodes 68. Top dielectric layer 72 and MgO protective layer 74 are formed on the entire inner surface of second substrate 54 while covering discharge sustain electrodes 70.

The crossed region of address electrodes 58 and discharge sustain electrodes 70 forms discharge cell 56. Discharge cells 56R, 56G, 56B are internally filled with a discharge gas (a mixture of Ne—Xe).

In this embodiment, discharge sustain electrodes 70 are formed with a stripe pattern, and have a pair of bus electrodes 66*a*, 68*a* provided per the respective discharge cells, and a pair of protrusion electrodes 66*b*, 68*b* extended from bus electrodes 66*a*, 68*a* toward inside of respective discharge cells 56R, 56G, 56B while facing each other. Protrusion electrodes 66*b*, 68*b* are preferably formed with a transparent electrode material, such as indium tin oxide (ITO), and bus electrodes 66*a*, 68*a* preferably with a metallic electrode material, such as silver (Ag).

Referring to FIGS. 10 and 11, main barrier ribs 62 are positioned at display area 76 defined on first and second substrates 52, 54. Furthermore, dummy regions 78 are existent at the non-display area surrounding display area 76 while centering around the display area and facing the opposite end portions of the display area (the top and the bottom sides of the display area in the drawing), and dummy barrier ribs 80 are formed at the dummy regions.

Dummy regions 78 are introduced to prevent the non-uniform discharge edge effect at the outermost discharge cell within display area 76. In this embodiment, dummy barrier rib 80 placed at dummy region 78 intrinsically prevents the misdischarging at display area 76, and in addition, inhibits the distortion of main barrier ribs 62 by caving some portion thereof when main barrier ribs 62 and dummy barrier ribs 80 are patterned and fired at a high temperature.

Figure 12:
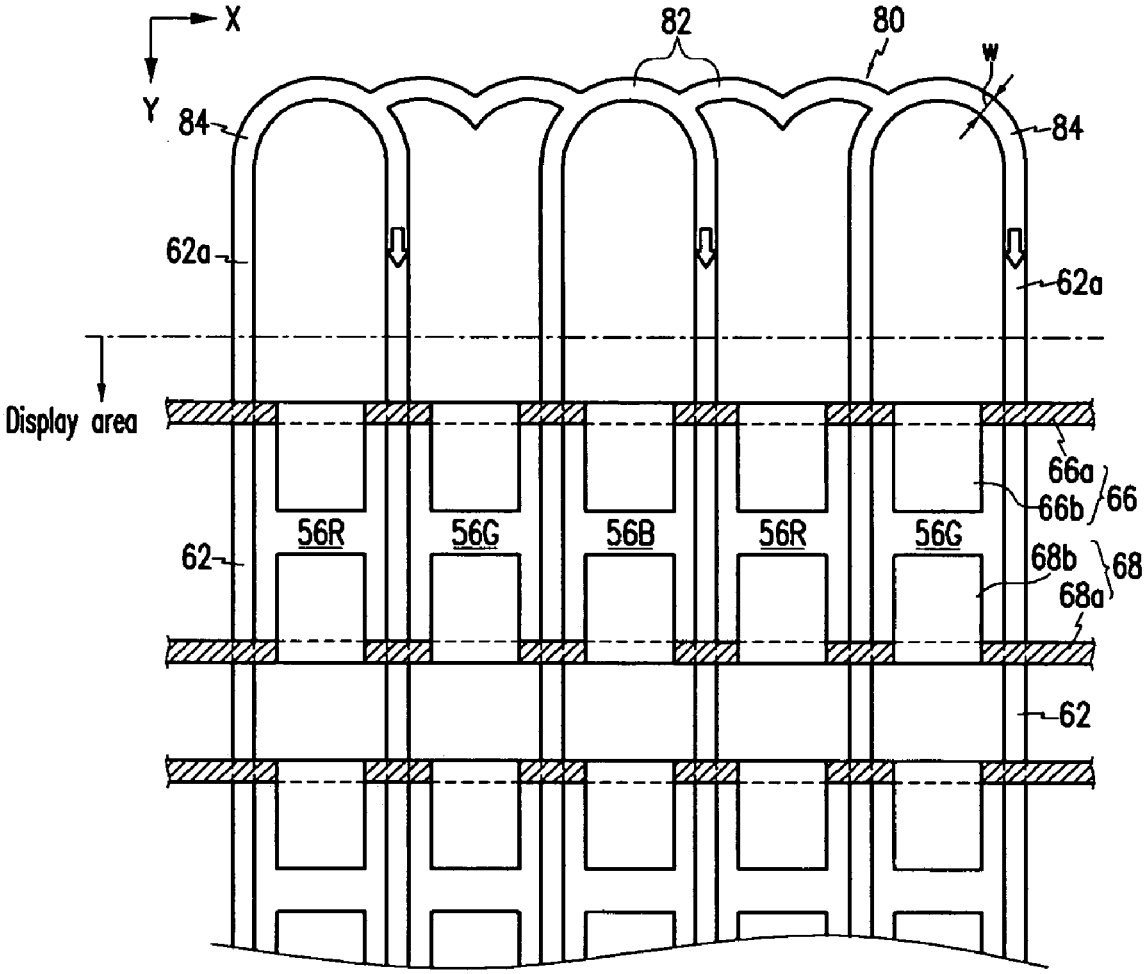
FIG. 12 is a partial plan view of the PDP shown in FIG. 10.

FIG. 12 is a partial schematic plan view of the PDP shown in FIG. 10. As shown in FIG. 12, dummy barrier ribs 80 have main dummy barrier ribs 82 formed with a plurality of arc portions serially connected to each other in a direction perpendicular to main barrier ribs 62 (in the X direction of the drawing), and interconnection dummy barrier ribs 84 extended from the portions of main dummy barrier ribs 84 facing main barrier ribs 62 toward main barrier ribs 62 to interconnect main dummy barrier ribs 82 and end portions 62*a* of main barrier ribs 62.

Main dummy barrier ribs 82 are arranged to be convex toward the outside of substrates 52, 54 such that the curvature center of the arc portions thereof is biased toward main barrier ribs 62. Interconnection dummy barrier ribs 84 can be extended from the arc portions forming main dummy partition ribs 82 toward main barrier ribs 62 substantially with the same curvature.

With dummy barrier ribs 80 having arc-patterned main dummy barrier ribs 82 and interconnection dummy barrier ribs 84 connected thereto, the width of main dummy barrier ribs 82 and interconnection dummy barrier ribs 84 is preferably established to be about 80 μm.

As described above, in this embodiment, dummy barrier ribs 80 have main dummy barrier ribs 82 and interconnection dummy barrier ribs 84, and are connected to end portions 62*a* of main barrier ribs 2. Dummy barrier ribs 40 are not formed with sharp edges, but with arc portions having a curvature. Particularly, interconnection dummy barrier ribs 84 are extended from main dummy barrier ribs 82 toward main barrier ribs 62 with a curvature to thereby interconnect main dummy barrier ribs 82 and main barrier ribs 62 smoothly.

With the manufacturing of the PDP, when main barrier ribs 62 are contracted toward the center of display area 76 through the firing, interconnection dummy barrier ribs 84 move in the direction of the contraction of main barrier ribs 62 to prevent main barrier ribs 62 from being caved. Furthermore, the distortion of dummy barrier ribs 80 is minimized so that the shape uniformity can be obtained at end portions 62*a* of main barrier ribs 62.

Specifically, a barrier rib formation material is coated onto the top surface of bottom dielectric layer 60 of first substrate 52, and patterned using a technique of sand blasting, pressing, or etching based on a photoresist film such that it has main barrier ribs 62 and dummy barrier ribs 80. When the patterned is fired at a high temperature of 450° C. or more, end portions 62*a* of main barrier ribs 62 move toward the inside of display area 76 by the guidance of the force of contraction directed toward the inside of the display area (in the direction of the arrow of FIG. 12).

In this process, as interconnection dummy barrier ribs 84 of dummy barrier ribs 80 proceed toward main barrier ribs 62 with a curvature, end portions 62*a* of main barrier ribs 62 move toward the inside of display area 76 together with interconnection dummy barrier ribs 84 to thereby prevent end portions 62*a* of main barrier ribs 62 from being caved. Consequently, main barrier ribs 62 are uniformly formed in the direction of address electrodes 58 with a height, and a gap is not made between the main barrier ribs and front substrate 64 with a resulting reduction of noise occurrence in the PDP.

Table 3 illustrates the front and rear-sided noise measurement results with respect to the PDP related to the Comparative Example, and the PDP with dummy barrier ribs 80 related to the second embodiment of the present invention.

TABLE 3

| | Comparative Example | Example |
|---|---|---|
| PDP inner gas pressure (Torr) | 650 | 650 |
| PDP front-sided noise (dB) | 43 | 35 |
| PDP rear-sided noise (dB) | 49 | 41 |

As listed in Table 3, it turned out that the front and the rear-sided noises were all reduced with the PDP according to the Example, as opposed to the PDP according to the Comparative Example.

Variations of the PDP according to the second embodiment of the present invention will be now explained with reference to FIGS. 13 to 15.

Figure 13:
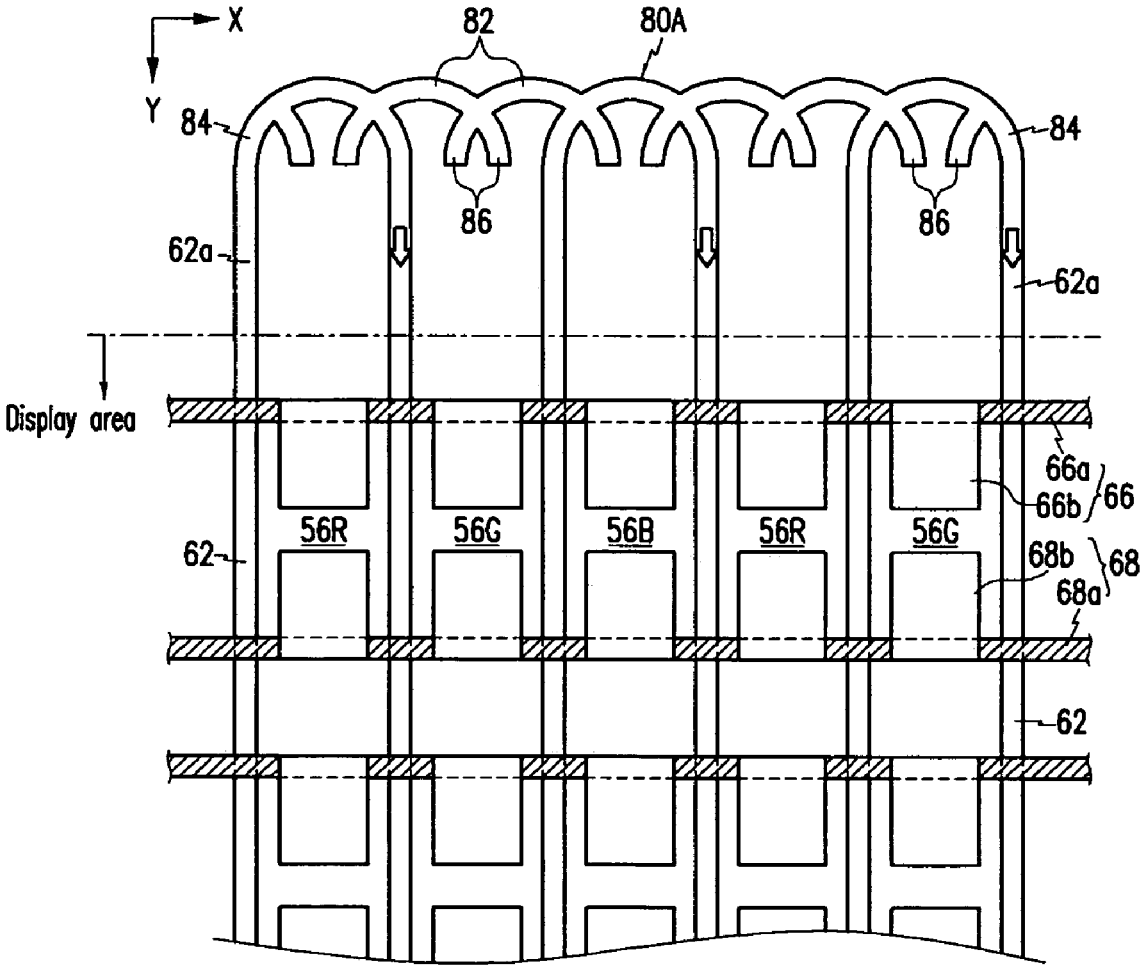
FIG. 13 is a partial plan view of the PDP according to the second embodiment of the present invention, illustrating a first variation thereof.

FIG. 13 illustrates a first variation of the PDP, which basically has the structure related to the second embodiment of the present invention. With this variation, subsidiary dummy barrier ribs 86 are further formed at the one sided region of main dummy barrier ribs 82. As with the interconnection dummy barrier ribs 84, subsidiary dummy barrier ribs 86 are extended from the arc portions forming main dummy barrier ribs 82 toward main barrier ribs 62 substantially with the same curvature. A pair of subsidiary dummy barrier ribs 86 are arranged between the two interconnection dummy barrier rib neighbors 84.

Subsidiary dummy barrier ribs 86 make dummy barrier ribs 80A harder, and during the firing of the barrier ribs, when main barrier ribs 62 are contracted toward the inside of the display area, subsidiary dummy barrier ribs 86 enhance the endurance of dummy barrier ribs 80A, and inhibit the distortion of dummy barrier ribs 80A. With the PDP having the varied structure, the shape uniformity of end portions 62*a* of the main barrier ribs is enhanced, and the quality of the PDP is heightened.

Figure 14:
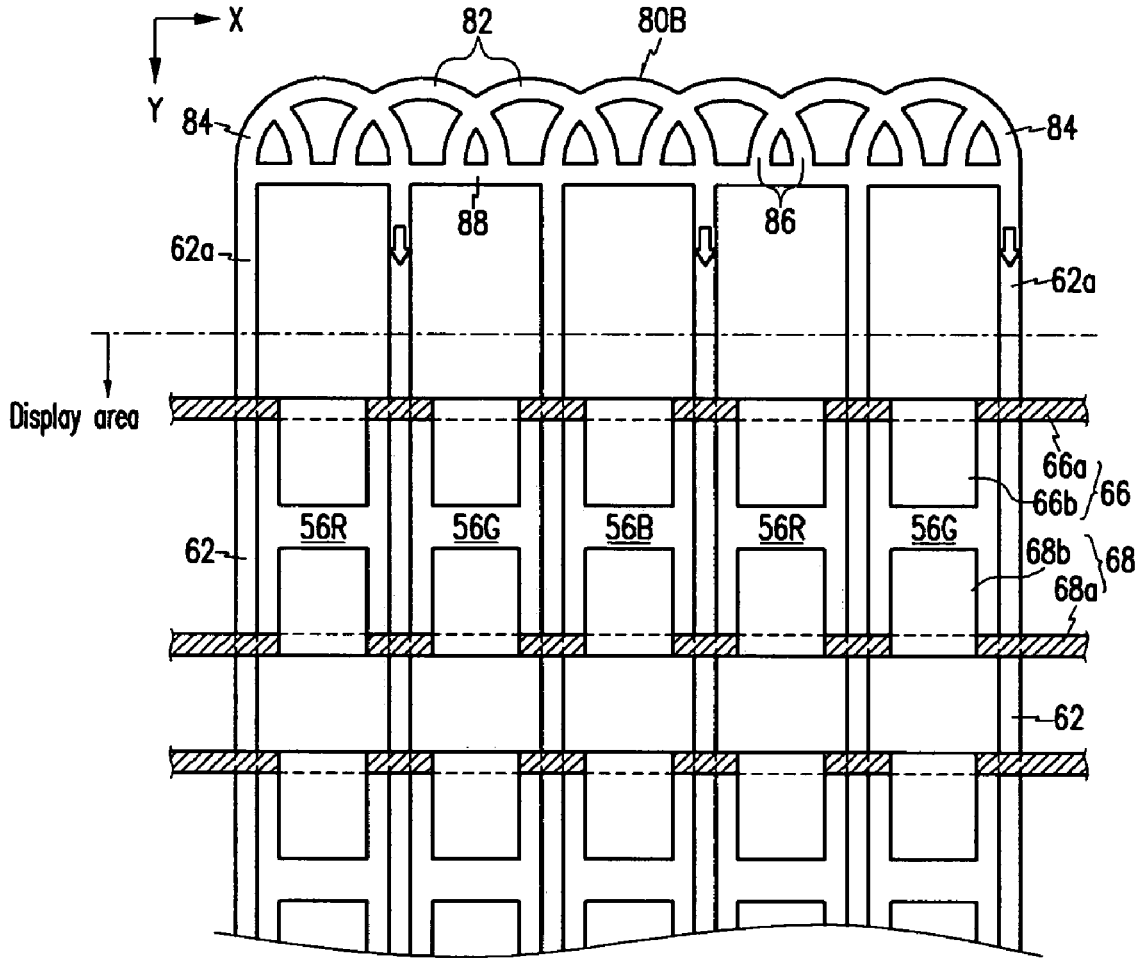
FIG. 14 is a partial plan view of the PDP according to the second embodiment of the present invention, illustrating a second variation thereof.

FIG. 14 illustrates a second variation of the PDP according to the second embodiment of the present invention, which basically has the structure related to the first variation. Separation barrier ribs 88 are formed between main barrier ribs 62 and dummy barrier ribs 80B.

Separation barrier ribs 88 are formed in a direction perpendicular to main barrier ribs 62 (in the X direction of the drawing) to interconnect end portions 62*a* of main barrier ribs 62, and like subsidiary dummy barrier ribs 86, make dummy barrier ribs 80B harder.

Figure 15:
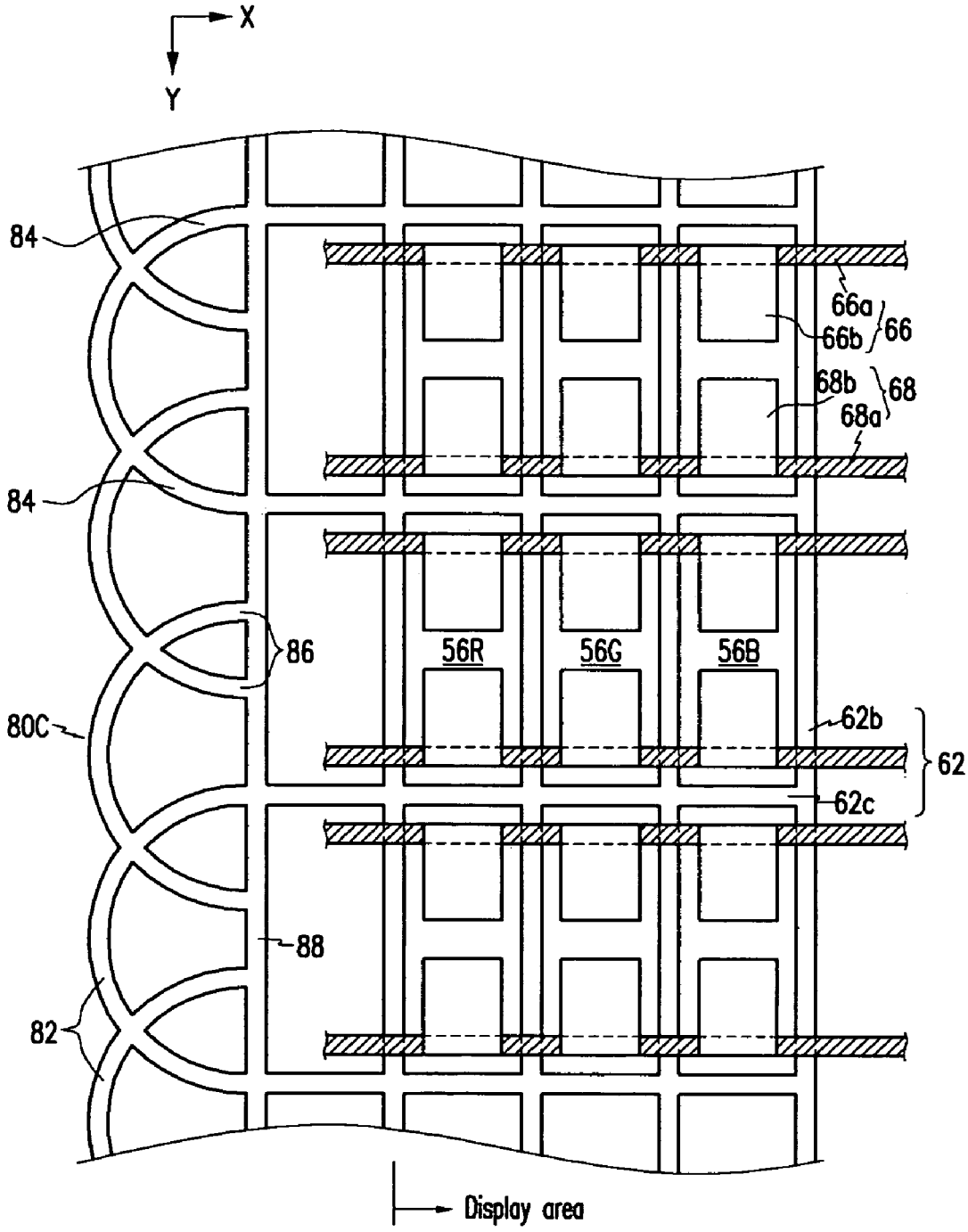
FIG. 15 is a partial plan view of the PDP according to the second embodiment of the present invention, illustrating a third variation thereof.
Figure 16:
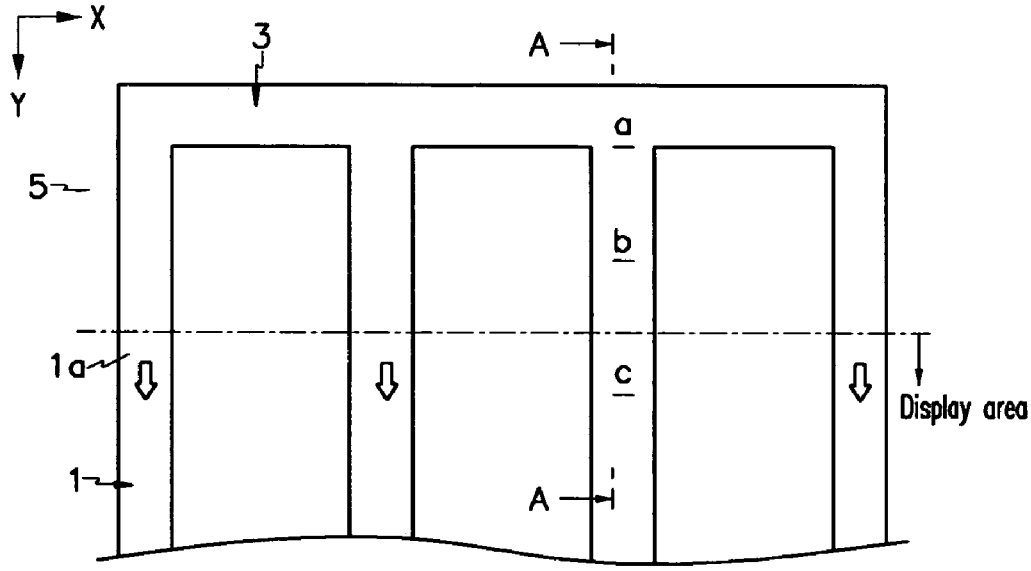
FIG.16(Prior Art)
FIG. 16 is a partial plan view of a PDP according to the prior art.
Figure 17:
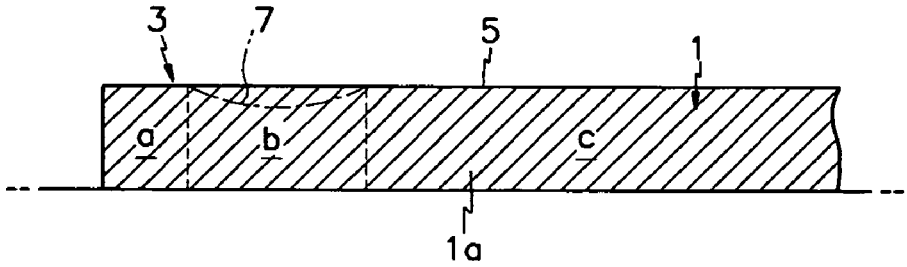
FIG.17(Prior Art)
FIG. 17 is a cross-sectional view of the PDP taken along the A—A line of FIG. 16.
Figure 18:
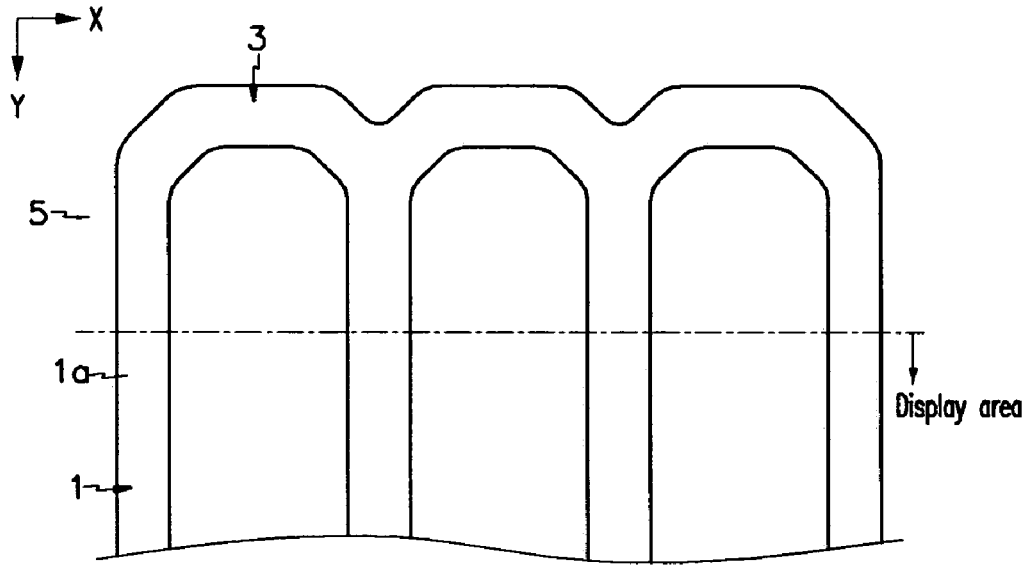
FIG.18(Prior Art)
FIG. 18 is a partial plan view of the PDP according to the prior art illustrating the distortion of the barrier rib after the firing.
Figure 19:
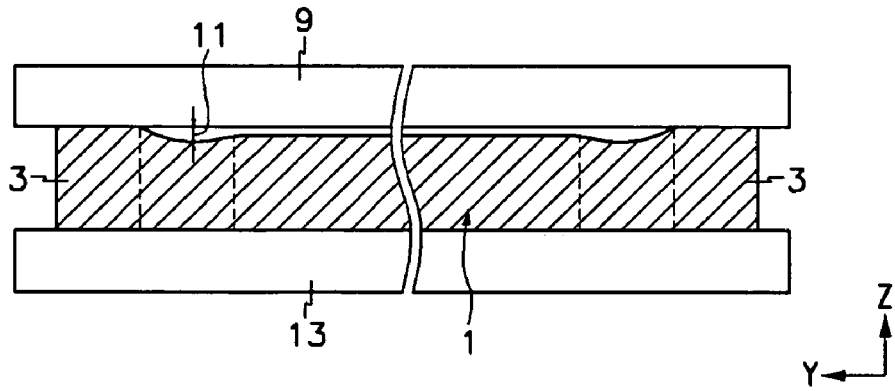
FIG.19(Prior Art)
FIG. 19 is a sectional view of the PDP according to the prior art.

FIG. 15 is a third variation of the PDP according to the second embodiment of the present invention, which basically has the structure related to the second variation. Dummy barrier ribs 80C and separation barrier ribs 88 are sided with two other opposite end portions of the display area (at the left and the right end portions thereof based on the drawing) facing each other. Dummy barrier ribs 80C and separation barrier ribs 88 are arranged at the extra region facing the left-sided end portion of the display area together with main barrier ribs 62. Main barrier ribs 62 are lattice-patterned with first barrier rib portions 62*b* proceeding in a direction of the address electrodes (in the Y direction of the drawing), and second barrier rib portions 62*c* proceeding in a direction perpendicular to the address electrodes (in the X direction of the drawing).

Dummy barrier ribs 80 and 80A to 80C, and separation barrier ribs 88 contact at least one of the upper and lower end portions and the left and right end portions of the display area. Particularly when main barrier ribs 62 are lattice-patterned, it is preferable that dummy barrier ribs 80C and separation barrier ribs 88 are arranged at the extra regions facing the left and right end portions of the display area to inhibit the distortion at the left and right end portions of main barrier ribs 62, and main dummy barrier ribs 82 and separation barrier ribs 86 proceed in a direction perpendicular to second barrier rib portions 82*c*.

As described above, when the main barrier ribs are contracted toward the inside of the display area during the firing process, the interconnection portions of the dummy barrier ribs move together with the main barrier ribs to prevent the main barrier ribs from being caved. Consequently, the possible gap between the main barrier ribs and the front substrate is minimized to thereby inhibit the noise occurrence. Furthermore, the distortion of the end portions of the main barrier ribs and the dummy barrier ribs is inhibited to thereby enhance the shape uniformity of the barrier ribs.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A plasma display panel comprising:

a first substrate and a second substrate spaced apart from each other at a distance and proceeding substantially parallel to each other, the first substrate and the second substrate having a display area and a non-display area;

a plurality of address electrodes formed on the first substrate and covered by a dielectric layer;

main barrier ribs arranged between the substrates to form discharge cells;

phosphor layer formed within the discharge cells;

a plurality of discharge sustain electrodes formed on the surface or the second substrate facing the first substrate and covered by a dielectric layer; and reinforcing barrier ribs arranged at the non-display area while surrounding the display area, and connected to the main barrier ribs with an outer structure curved toward the outside of the substrates.

2. The plasma display panel of claim 1 wherein the reinforcing barrier ribs surround at least one edge of the display area.

3. The plasma display panel of claim 1 wherein the reinforcing barrier ribs surround all four edges of the display area.

4. The plasma display panel of claim 1 wherein a thickness of the reinforcing barrier ribs is substantially the same as the thickness of the main barrier ribs, the thickness being along a direction between the first substrate and the second substrate.

5. The plasma display panel of claim 1 wherein the reinforcing barrier ribs have a width gradually reduced from the center thereof to both end portions thereof, the width being along a direction substantially parallel to the first substrate and the second substrate.

6. The plasma display panel of claim 1 wherein the reinforcing barrier ribs are outlined with an arc.

7. The plasma display panel of claim 1 wherein the reinforcing barrier ribs are outlined with a plurality of arcs.

8. The plasma display panel of claim 7 wherein the arc portions of the reinforcing barrier ribs are differentiated in the thickness thereof.

9. The plasma display panel of claim 8 wherein the arc portion of the reinforcing barrier rib with the small thickness is thinner than the thickness of the main barrier rib.

10. The plasma display panel of claim 7 wherein the respective arc portions of the reinforcing barrier ribs correspond to a discharge cell formed by the main barrier ribs.

11. The plasma display panel of claim 7 wherein the respective arc portions of the reinforcing barrier ribs correspond to two or more discharge cells formed by the main barrier ribs.

12. A plasma display panel comprising:

a first substrate and a second substrate facing each other;

address electrodes formed on the first substrate;

main barrier ribs arranged between the first substrate and the second substrate within a display area to form discharge cells;

phosphor layer formed at the respective discharge cells;

a plurality of discharge sustain electrodes formed on the second substrate; and dummy barrier ribs arranged at a non-display region sided with at least one end portion of the display area;

wherein the dummy barrier ribs comprise main dummy barrier ribs spaced apart from the end portions of the main barrier ribs at a distance while proceeding in a direction of the display area, and interconnection dummy barrier ribs extended from the main dummy barrier ribs toward the main barrier ribs with a curvature and connected to the main barrier ribs.

13. The plasma display panel of claim 12 wherein the dummy barrier ribs are arranged at non-display regions sided with two opposite-end portions of the display area facing each other, and the main dummy barrier ribs proceed perpendicular to the address electrodes.

14. The plasma display panel of claim 13 wherein the dummy barrier ribs are arranged at non-display regions sided with two other opposite-end portions of the display area racing each other, and the main dummy barrier ribs proceed parallel to the address electrodes.

15. The plasma display panel of claim 12 wherein the main dummy barrier ribs have a plurality of are portions serially connected to each other.

16. The plasma display panel of claim 15 wherein the arc portions are convex toward the outside of the substrates.

17. The plasma display panel of claim 15 wherein the arc portions have substantially the same curvature as the interconnection dummy barrier ribs.

18. The plasma display panel of claim 12 wherein the main dummy barrier rib and the interconnection dummy barrier rib are connected to each other to form an arc portion.

19. The plasma display panel of claim 12 wherein the dummy barrier ribs further comprise subsidiary dummy barrier ribs placed at the one-sided region of the main dummy barrier ribs facing the main barrier ribs.

20. The plasma display panel of claim 19 wherein the main dummy barrier ribs have a plurality of arc portions serially connected to each other, and the subsidiary dummy barrier ribs arc extended toward the main barrier ribs substantially with the same curvature as the arc portions.

21. The plasma display panel of claim 20 wherein the subsidiary dummy barrier ribs are arranged between the two interconnection dummy barrier rib neighbors pair by pair.

22. The plasma display panel of claim 12 wherein separation barrier ribs are provided between the main barrier ribs and the dummy barrier ribs.

23. The plasma display panel of claim 22 wherein the separation barrier ribs proceed substantially parallel to the main dummy barrier ribs.

24. The plasma display panel of claim 12 wherein the main barrier ribs are stripe-patterned while proceeding parallel to the address electrodes.

25. The plasma display panel of claim 12 wherein the main barrier ribs are lattice-patterned with first barrier rib portions proceeding parallel to the address electrodes, and second barrier rib portions proceeding perpendicular to the address electrodes.

* * * * *